US007464885B1

(12) United States Patent
Chang

(10) Patent No.: US 7,464,885 B1
(45) Date of Patent: Dec. 16, 2008

(54) SPRAYING HEAD ASSEMBLY

(75) Inventor: Ming-Sheh Chang, Fengyuan (TW)

(73) Assignee: Tanong Precision Technology Co., Ltd (TW)

( * ) Notice: Subject to any disclaimer, the term of this patent is extended or adjusted under 35 U.S.C. 154(b) by 0 days.

(21) Appl. No.: 11/889,116

(22) Filed: Aug. 9, 2007

(51) Int. Cl.
*B05B 1/30* (2006.01)

(52) U.S. Cl. ..... 239/571; 239/463; 239/491; 239/533.1; 239/533.15; 239/570; 239/596; 239/600

(58) Field of Classification Search ..... 239/463, 239/482, 490, 491, 492, 533.1, 533.15, 550, 239/570, 571, 579, 589, 596, 600
See application file for complete search history.

(56) References Cited

U.S. PATENT DOCUMENTS 1,220,279 A * 3/1917 Sexton ..... 239/533.15
3,889,881 A * 6/1975 Cunningham et al. ..... 239/70
5,002,230 A * 3/1991 Norskov et al. ..... 239/533.15
6,415,994 B1 * 7/2002 Boggs ..... 239/463

* cited by examiner

*Primary Examiner*—Steven J Ganey
(74) *Attorney, Agent, or Firm*—Hershkovitz & Associates, LLC; Abe Hershkovitz

(57) ABSTRACT

A spraying head assembly has a tubular body, a cap, an upper plug, a lower plug and a spring. The cap is attached to the body and has a spraying channel, a conical cavity and a spraying hole. The conical cavity is defined inside the cap and communicates with the spraying channel and the spraying hole. The upper plug is held in the body and comprises a spraying end, a connecting end, a head and shaft. The head has a recess communicating with the spraying channel having a conical bottom. Multiple passages are defined in the head and communicate with the recess. The lower plug is mounted movably in the chamber in the body and is connected to the upper plug using the spring. In this arrangement, a liquid supplied to the connecting end forms vortexes in the body to reduce particles of liquid nebulization and raise ejection speed and therefore distance.

8 Claims, 7 Drawing Sheets

SPRAYING HEAD ASSEMBLY

BACKGROUND OF THE INVENTION

1. Field of the Invention

The present invention relates to a spraying head assembly, and more particularly to a spraying head assembly that reduces liquid nebulization and raises a liquid ejection distance.

2. Description of Related Art

With reference to FIGS. 6 and 7, a conventional spraying head is used to spray liquids and comprises a body (60), a cap (61), a pressing tab (611), an upper plug (62), a lower plug (64) and a spring (63). The body (60) is tubular and has a spraying end, a connecting end, a chamber (601) and a connecting channel (602). The connecting end of the body (60) is connected to a pipe using threads. The chamber (601) and the connecting channel (602) are defined respectively in the spraying end and connecting ends of the body (60) and communicate with each other to define a shoulder between the chamber (601) and the connecting channel (602).

The cap (61) is attached to the spraying end and has a through hole defined through the cap (61).

The pressing tab (611) is squeezed between the spraying end of the body (60) and the cap (61) and corresponds to and closes the through hole in the cap (61). The pressing tab (611) has a hollow protrusion, a spraying hole (612) defined through the center of the hollow protrusion and multiple spraying channels (613) and a bottom. The spraying channels (613) are formed tangentially from the hollow protrusion in the bottom of the pressing tab (611).

The upper plug (62) is held in the chamber (601) of the body (60) and abuts the pressing tab (611). The upper plug (62) is smaller than the chamber (601) so defines a gap between the upper plug (62) and the inner surface of the chamber (601), which communicates with the spraying channels (613) in the pressing tab (611).

The lower plug (64) is mounted moveably in the chamber (601) of the body (60) and abuts the shoulder in the body (60).

The spring (63) is connected between the upper and lower plugs (62,64) to push the lower plug (64) to prevent the chamber (601) communicating with the connecting channel (602).

When the liquid is forced into the body (60) through the connecting channel (602) from a pipe, the lower plug (64) is dislodged to allow the liquid to enter the chamber (601). The liquid flow from the chamber (601), through the spraying channels (613) and hollow protrusion in the pressing tab (611) and ejected from the spraying hole (612) in the pressing tab (611) in a jet. With the arrangement of the spraying channels (613), a vortex will occur inside the hollow protrusion such that the liquid sprayed out from the spraying hole is nebulized.

However, only one vortex occurs before the liquid is ejected from the conventional spraying head, so particles of the jet are large and only travel a short distance. Therefore, a spraying range of the conventional spraying head is limited.

To overcome the shortcomings, the present invention tends to provide a spraying head assembly to mitigate or obviate the aforementioned problems.

SUMMARY OF THE INVENTION

The main objective of the invention is to provide a spraying head assembly that reduces particles of liquid nebulization and raises a liquid ejection distance. The spraying head assembly has a tubular body, a cap, an upper plug, a lower plug and a spring. The tubular body has a connecting end, a spraying end, a connecting tube, a connecting channel and a chamber. The connecting tube is formed on and protrudes from the connecting end. The connecting channel is defined through the connecting tube and has a diameter. The chamber is defined in the spraying end, communicates with the connecting channel and has an inner surface and a diameter larger than that of the channel to define a shoulder between the chamber and the connecting channel. The cap is attached to the spraying end of the body and has a spraying end, a connecting end, a spraying channel, a conical cavity and a spraying hole. The connecting end is connected with the spraying end of the body. The spraying channel is defined in the cap. The conical cavity is defined inside the cap and communicates with the spraying channel. The spraying hole is defined in the spraying end of the cap and communicates with the conical cavity. The upper plug is held in the chamber in the body and comprises a spraying end, a connecting end, a head and a shaft. The head is smaller than the chamber so defines a gap between the head and the inner surface of the chamber and is formed on the spraying end of the upper plug and has a top abutting the cap, a bottom, a recess and multiple passages. The recess is defined in the top of the head, communicates with the spraying channel in the cap and has a conical bottom. The passages are defined in the head and communicate with the recess and the gap between the head and the inner surface of the chamber. The shaft is formed on and protrudes from the bottom of the head. The lower plug is mounted movably in the chamber in the body, is connected to the upper plug and has a top, a bottom, a post and a sealing block. The post is formed on the top of the lower plug. The sealing block is formed on the bottom of the lower plug to selectively close the connecting channel in the body. The spring is connected between the upper plug and the lower plug and has an upper end mounted around the shaft on the upper plug and a lower end mounted around the post on the lower plug. In this arrangement, a liquid supplied to the connecting end forms vortexes in the body to reduce particles of liquid nebulization and raise ejection speed and therefore distance.

Other objects, advantages and novel features of the invention will become more apparent from the following detailed description when taken in conjunction with the accompanying drawings.

DETAILED DESCRIPTION OF PREFERRED EMBODIMENT

Figure 1:
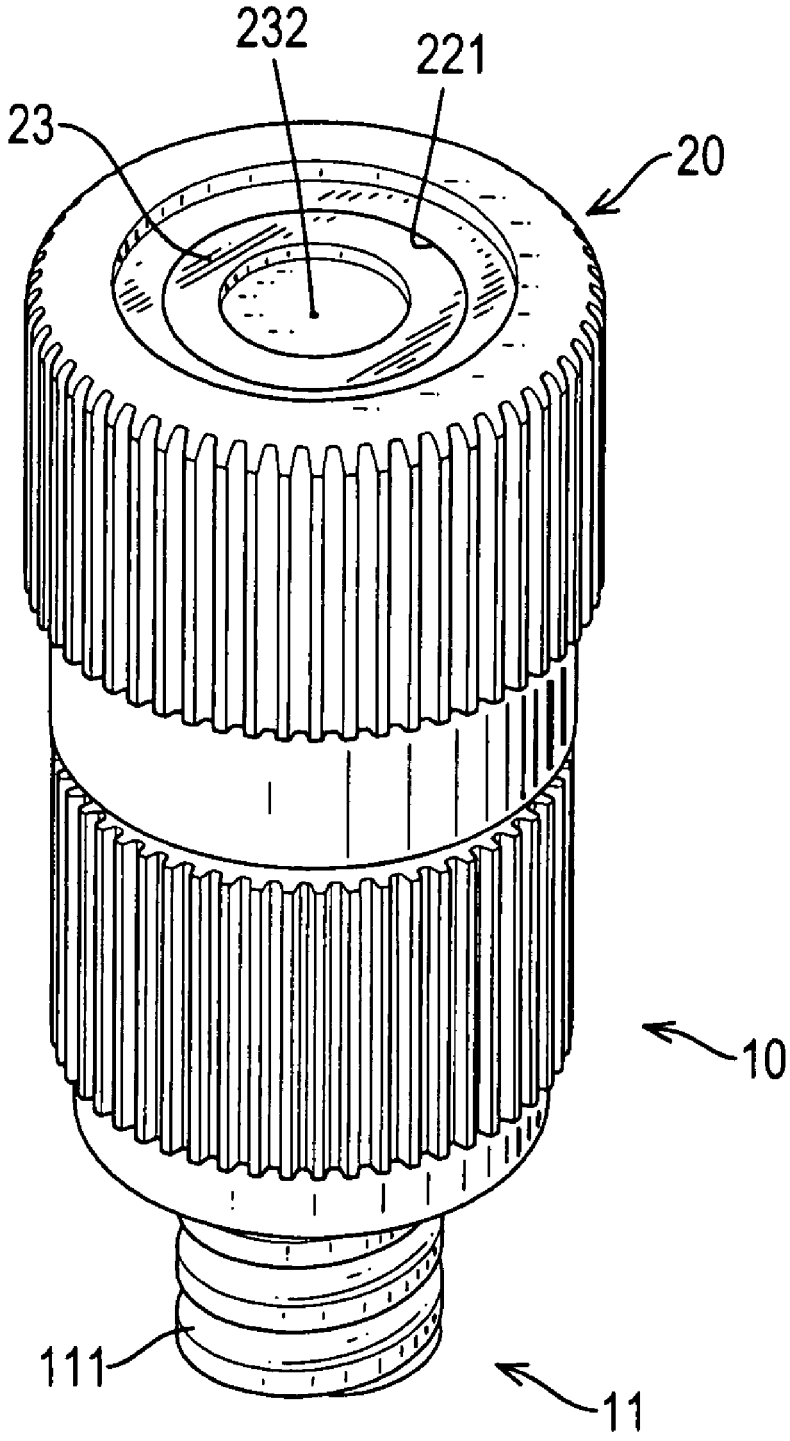
FIG. 1 is a perspective view of a spraying head assembly in accordance with the present invention.
Figure 2:
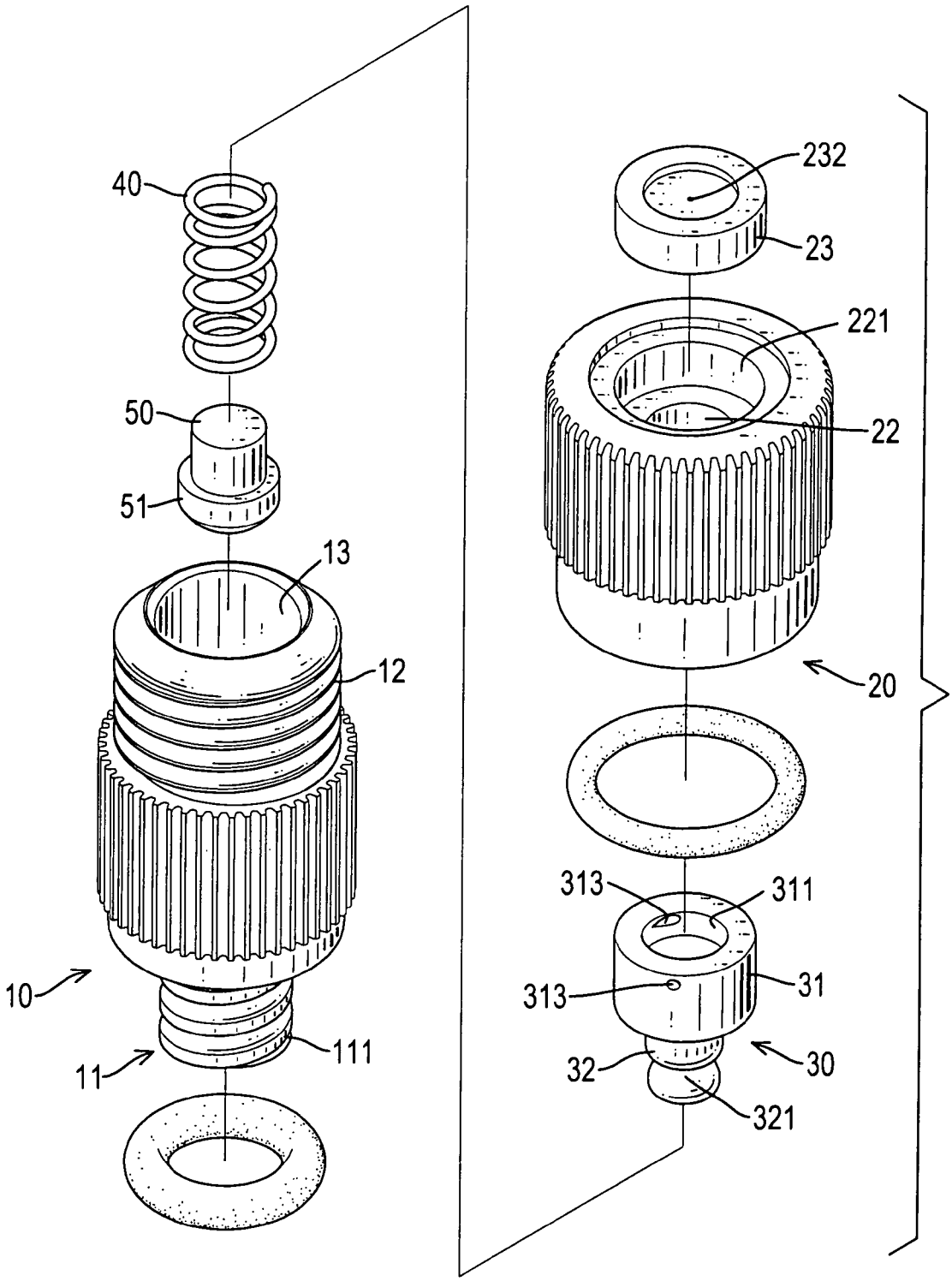
FIG. 2 is an exploded perspective view of the spraying head assembly in FIG. 1.
Figure 3:
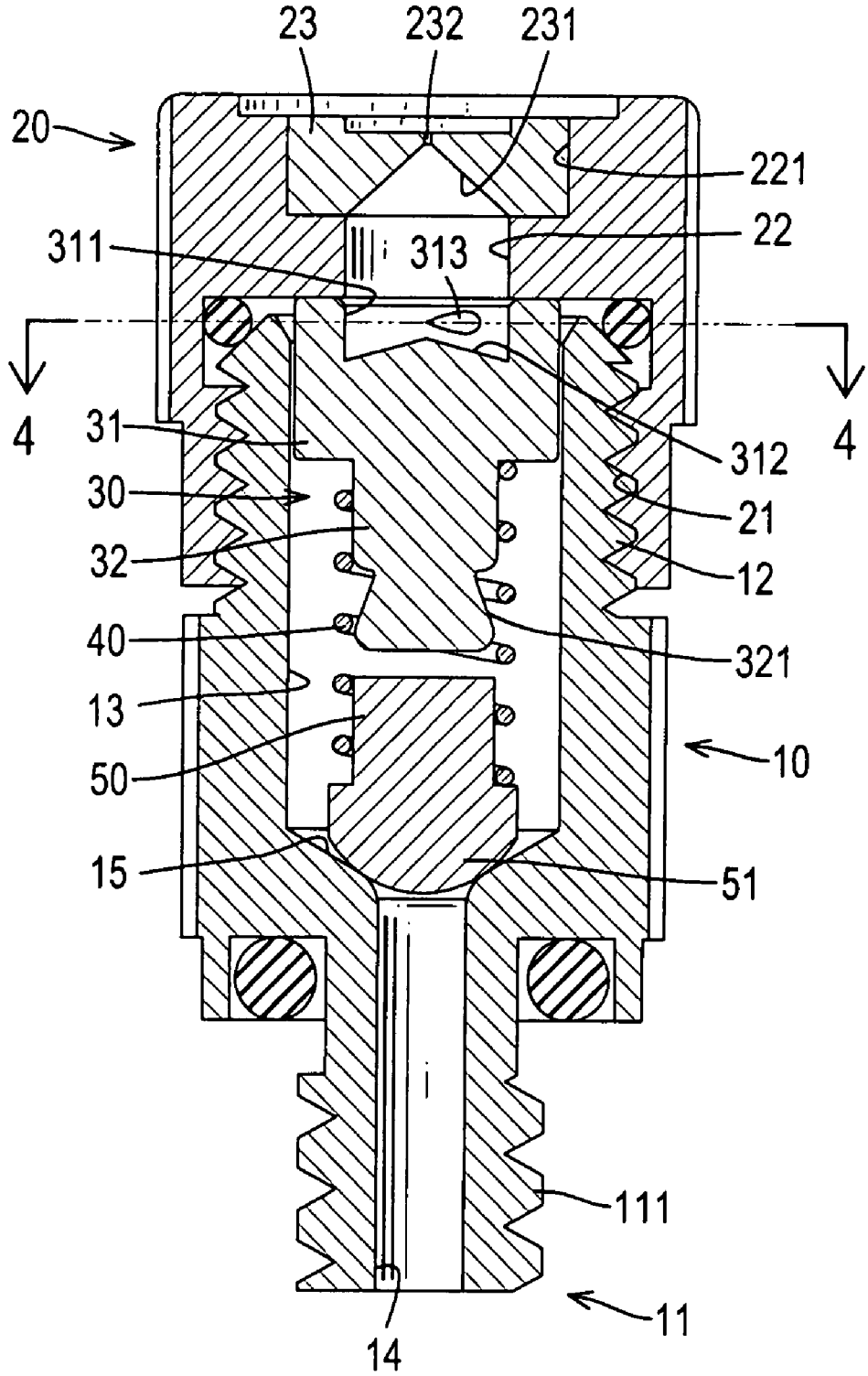
FIG. 3 is a cross sectional side view of the spraying head assembly in FIG. 1.

With reference to FIGS. 1 to 3, a spraying head assembly in accordance with the present invention comprises a body (10), a cap (20), an upper plug (30), a lower plug (50) and a spring (40). The body (10) is tubular and has a connecting end, a spraying end, a connecting tube (11), a connecting channel (14), a chamber (13) and two outer threads (111,12). The connecting tube (11) is formed on and protrudes from the connecting end. The connecting channel (14) is defined through the connecting tube (11) and has a diameter. The chamber (13) is defined in the spraying end, communicates with the connecting channel (11) and has an inner surface and a diameter larger than that of the channel (11) to define a shoulder (15) between the chamber (13) and the connecting channel (14). The shoulder (15) between the chamber (13) and the connecting channel (14) may be conical and formed concavely from the body. The outer threads (111,12) are formed respectively on the connecting end and the spraying end. The outer thread (111) on the connecting end is screwed onto a pipe to connect the tubular body (10) to the pipe.

The cap (20) is attached to the spraying end of the body (10) and has a spraying end, a connecting end, an inner thread (21), a spraying channel (22), a conical cavity (231) and a spraying hole (232). The inner thread (21) is formed in the connecting end of the cap (20) and is screwed onto the outer thread (12) on the spraying end of the body (10) to connect the connecting end of the cap (20) onto the spraying end of the body (10). The spraying channel (22) is defined axially in the cap (20). The conical cavity (231) is defined concavely inside the cap (20) and communicates with the spraying channel (22). The spraying hole (232) is defined in the spraying end of the cap (20) and communicates with the conical cavity (231). In a preferred embodiment, the cap (20) may further have a holding cavity (221) and a spraying block (23). The holding cavity (221) is defined in the spraying end of the cap (20). The spraying block (23) is mounted securely in the holding cavity (221) and has a top and a bottom. The conical cavity (231) is defined concavely in the bottom of the spraying block (23), and the spraying hole (232) is defined in the top of the spraying block (23). In an alternative embodiment, the spraying block (23) is formed in the cap (20) to form the cap (20) as a single piece.

The upper plug (30) is mounted in the chamber (13) in the body (10) and comprises a spraying end, a connecting end, a head (31) and a shaft (32). The head (31) is smaller than the chamber (13 so defines a gap between the head (31) and the inner surface of the chamber (13) and is formed on the spraying end of the upper plug (30) and has a top, a bottom, a recess (311) and multiple passages (313). The top of the head (31) abuts the cap (20). The recess (311) is defined in the top of the head (31), communicates with the spraying channel (22) in the cap (20) and has a conical bottom (312) formed convexly in the recess (311). The passages (313) are formed through the head (31) and communicate with the recess (311) and the gap between the head (31) and the inner surface of the chamber (13).

Figure 4:
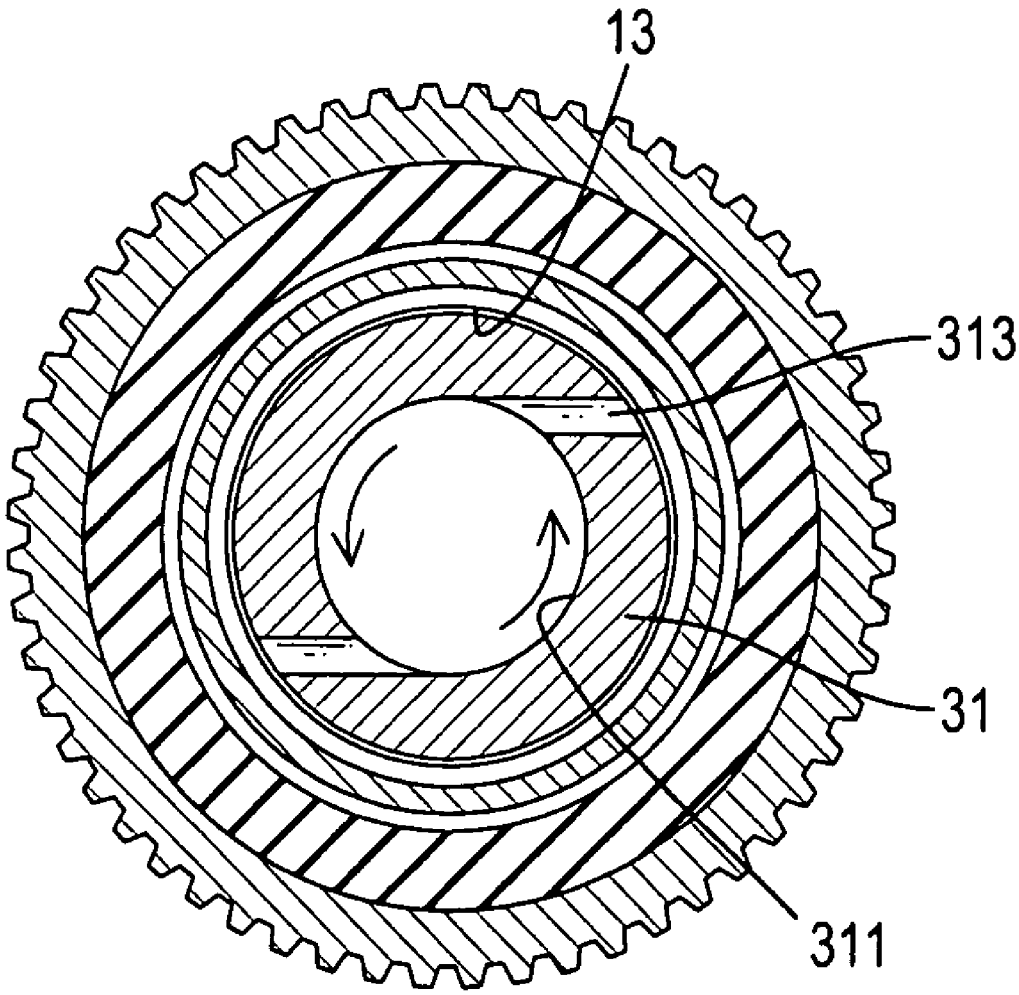
FIG. 4 is a cross sectional top view of the spraying head assembly along line 4-4 in FIG. 3.

With further reference to FIG. 4, in a preferred embodiment, the passages (313) are formed tangentially from recess (311) through the head (31).

The shaft (32) is formed on and protrudes from the bottom of the head (31) and has a neck (321) being smaller than the shaft (32).

The lower plug (50) is mounted movably in the chamber (13) in the body (10), is connected to the upper plug (30) and has a top, a bottom, a post and a sealing block (51). The post formed on the top of the lower plug (50). The sealing block (51) is formed on the bottom of the lower plug (50) to selectively close the connecting channel (14) in the body (10).

The spring (40) is connected between the upper plug (30) and the lower plug (50) to support the upper plug (30) inside the chamber (13) and has an upper end and a lower end. The upper end is mounted around the shaft (32) on the upper plug (30), and the lower end is mounted around the post on the lower plug (50).

Figure 5:
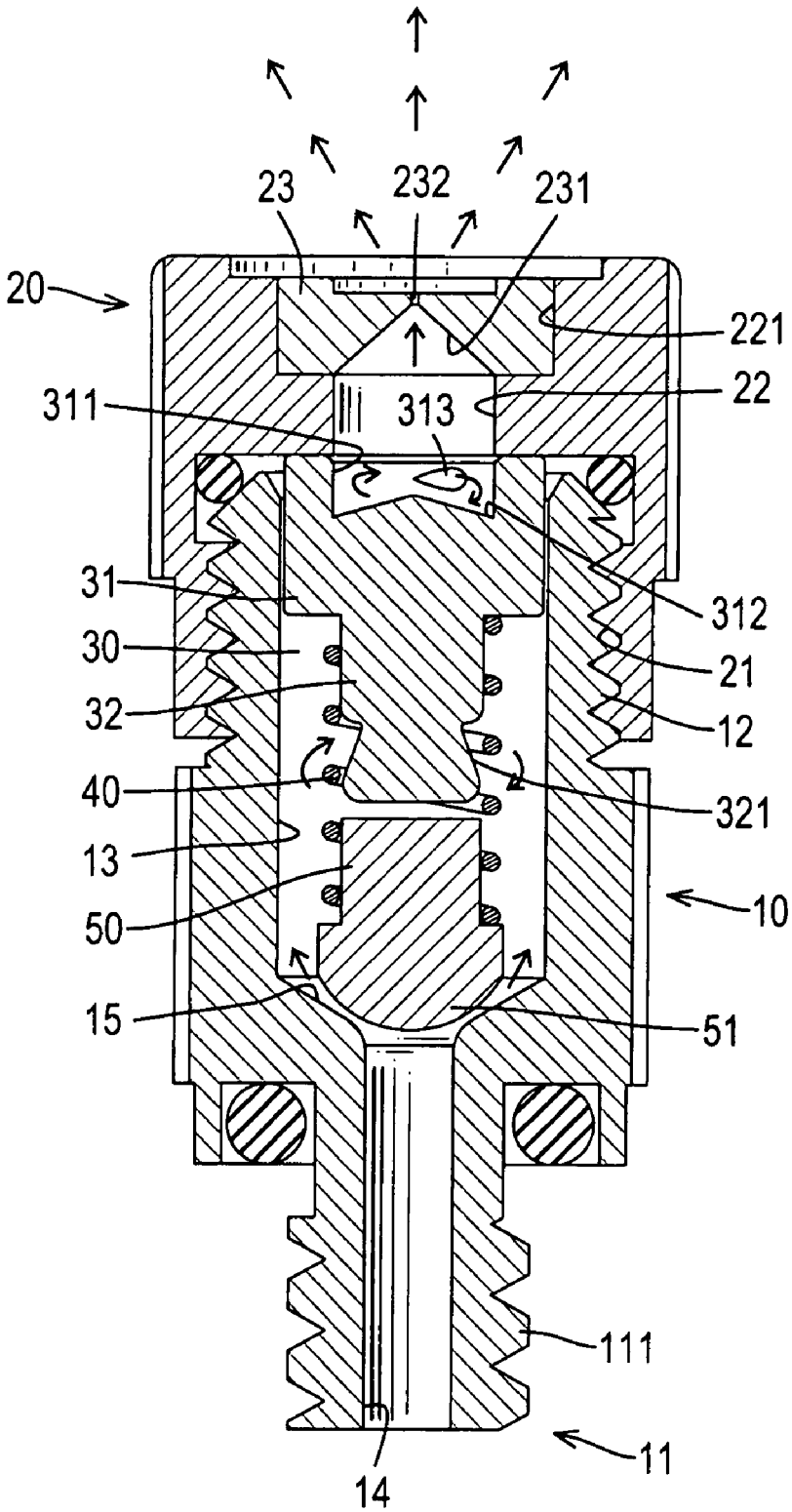
FIG. 5 is an operational cross section side view of the spraying head assembly in FIG. 1.
Figure 6:
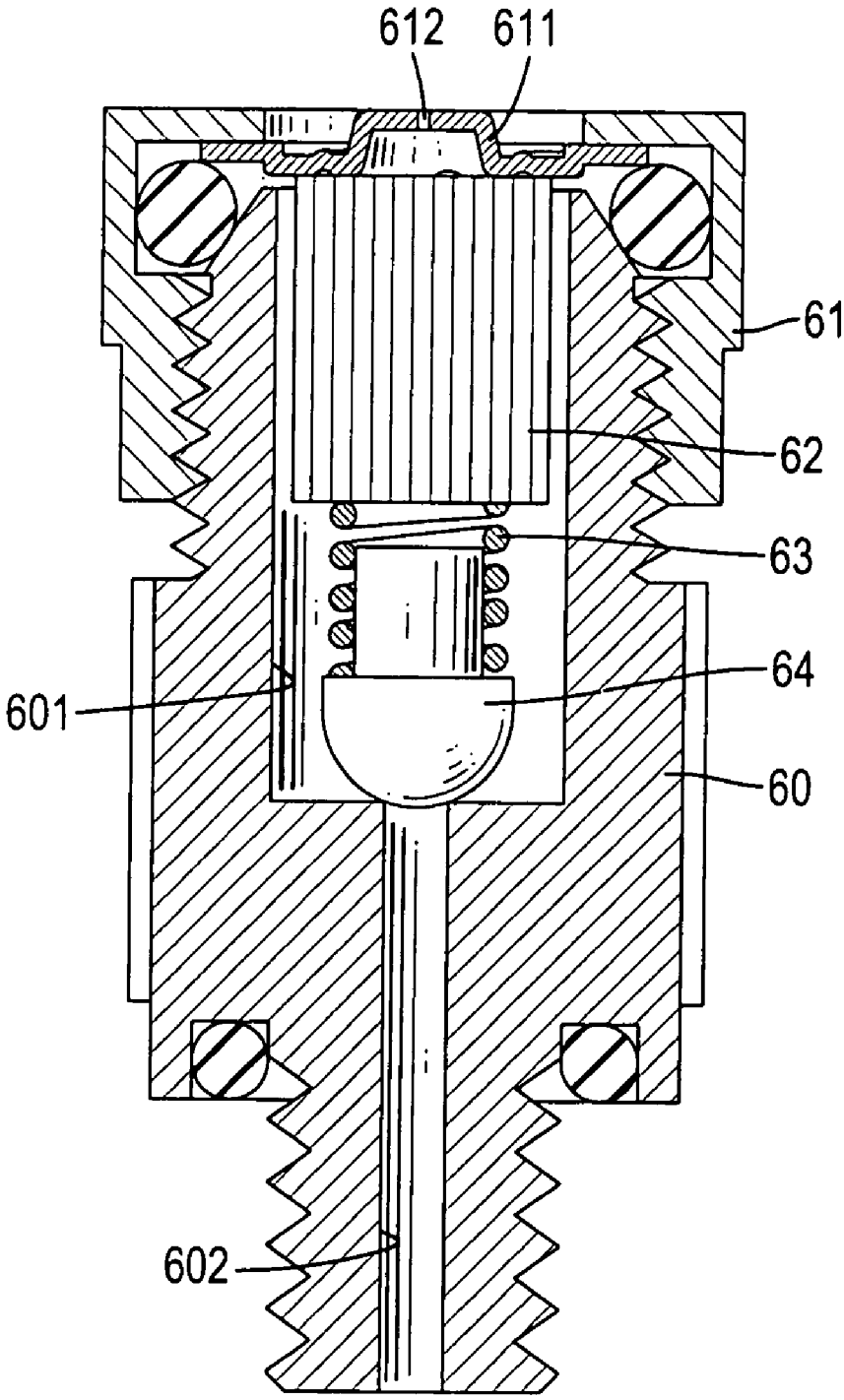
FIG.6 PRIOR ART
FIG. 6 is a side view in partial section of a conventional spraying head in accordance with the prior art.
Figure 7:
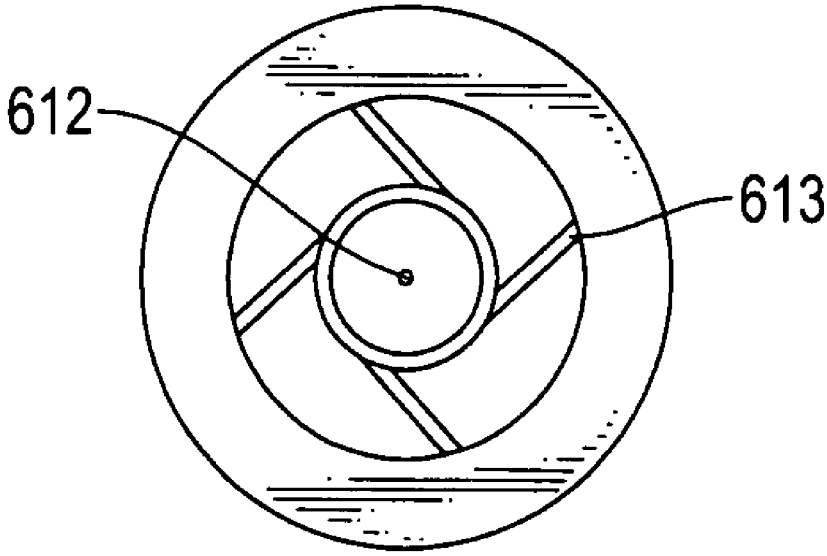
FIG.7 PRIOR ART
FIG. 7 is a bottom view of a pressing tab of the spraying head in FIG. 6.

With further reference to FIG. 5, when water is released into the connecting channel (14) from a pipe connected with the body (10), the lower plug (50) will be pushed away from the shoulder (15) to allow water to enter into the chamber (13). Due to the arrangement of the neck (321) on the shaft (32), a first vortex will occur inside the chamber (13). The water will then flow into the recess (311) in the head (31) of the upper plug (30) through the gap and the passages (313). Since the passages (313) in the head (31) are formed at tangents and the recess (311) has the conical bottom (312), a second vortex will form inside the recess (311). When the water flows into the conical cavity (231) in the cap (20) through the spraying channel (22), a third vortex will occur inside the conical cavity (231) due to the tapering of the conical cavity (231) and is then ejected from the spraying hole (232).

Because multiple vortexes occur before the water is ejected from the spraying head assembly, particles of liquid nebulization is minimized. With the shape of the conical cavity (231), the speed of liquid sprayed out from the spraying hole (232) is increased, so the travel and spraying range of the liquid jets are prolonged and enlarged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A spraying head assembly comprising:

a body being tubular and having
- a connecting end;
- a spraying end;
- a connecting tube being formed on and protruding from the connecting end;
- a connecting channel defined through the connecting tube and having a diameter; and
- a chamber defined in the spraying end, communicating with the connecting channel and having an inner surface and a diameter larger than that of the channel to define a shoulder between the chamber and the connecting channel;

a cap attached to the spraying end of the body and having
- a spraying end;
- a connecting end connected with the spraying end of the body;
- a spraying channel defined axially in the cap;
- a conical cavity defined concavely inside the cap and communicating with the spraying channel; and
- a spraying hole defined in the spraying end of the cap and communicating with the conical cavity;

an upper plug being mounted in the chamber in the body and comprising
- a spraying end;
- a connecting end;
- a head being smaller then the chamber so defining a gap between the head and the inner surface of the chamber and being formed on the spraying end of the upper plug and having
  - a top abutting the cap;
  - a bottom;

a recess defined in the top of the head, communicating with the spraying channel in the cap and having a conical bottom formed convexly in the recess; and multiple passages being formed through the head and communicating with the recess and the gap between the head and the inner surface of the chamber; and a shaft being formed on and protruding from the bottom of the head;

a lower plug being mounted movably in the chamber in the body, connected to the upper plug and having a top;

a bottom;

a post being formed on the top of the lower plug; and a sealing block being formed on the bottom of the lower plug to selectively close the connecting channel in the body; and a spring connected between the upper plug and the lower plug and having an upper end mounted around the shaft on the upper plug; and a lower end mounted around the post on the lower plug.

2. The spraying head assembly as claimed in claim 1, wherein the body further has two outer threads formed respectively on the spraying end and the connecting end; and the cap further has an inner thread formed in the connecting end of the cap and being screwed onto the outer thread on the spraying end of the body;

a holding cavity defined in the spraying end of the cap; and a spraying block held in the holding cavity and having a top and a bottom, wherein the conical cavity is defined concavely in the bottom of the spraying block; and the spraying hole is defined in the top of the spraying block.

3. The spraying head assembly as claimed in claim 2, wherein the shoulder between the chamber and the connecting channel is conical and formed concavely from the body.

4. The spraying head assembly as claimed in claim 3, wherein the passages are formed tangentially from the recess through the head.

5. The spraying head assembly as claimed in claim 4, wherein the shaft on the upper plug further has a neck being smaller than the shaft.

6. The spraying head assembly as claimed in claim 1, wherein the shoulder between the chamber and the connecting channel is conical and formed concavely from the body.

7. The spraying head assembly as claimed in claim 1, wherein the passages are formed tangentially from the recess through the head.

8. The spraying head assembly as claimed in claim 1, wherein the shaft on the upper plug further has a neck being smaller than the shaft.

* * * * *